US005921902A

United States Patent [19]

Carpenter

[11] Patent Number: 5,921,902

[45] Date of Patent: Jul. 13, 1999

[54] ADJUSTABLE HANDLEBAR FOR EXERCISE EQUIPMENT

[75] Inventor: David Paul Carpenter, Dunkirk, Md.

[73] Assignee: M. Michael Carpenter, Los Angeles, Calif.

[21] Appl. No.: 09/015,688

[22] Filed: Jan. 29, 1998

[51] Int. Cl.[6] ..... A63B 21/00; A63B 23/12

[52] U.S. Cl. ..... 482/139; 482/92; 482/99

[58] Field of Search ..... 482/72, 73, 92, 482/93, 99, 102, 103, 120, 123, 126, 129, 130, 133, 139, 908, 909, 148; D21/673, 674, 694; 74/551.3–551.5; 16/111 R; 441/69

[56] References Cited

U.S. PATENT DOCUMENTS

Re. 33,218 5/1990 Twardosz ..... 482/106
5,265,969 11/1993 Chuang ..... 74/551.3
5,273,509 12/1993 Vittone ..... 482/139
5,613,928 3/1997 Laudone ..... 482/139

FOREIGN PATENT DOCUMENTS 1066617 1/1984 U.S.S.R. ..... 482/909

*Primary Examiner*—John Mulcahy
*Attorney, Agent, or Firm*—M. Michael Carpenter

[57] ABSTRACT

An adjustable handlebar is shown having a first handle attached to a first disc and a second handle. An aperture passing through the first disc and second handle pivotally joins the two. A second set of apertures passing through the first disc and second handle receive a detent pin to adjustably set the angle between first and second handles.

16 Claims, 7 Drawing Sheets

ADJUSTABLE HANDLEBAR FOR EXERCISE EQUIPMENT

BACKGROUND OF THE INVENTION

1. Field of the Invention

The present invention relates to a handlebar for exercise equipment and, more particularly, to an adjustable handlebar that may be used with exercise equipment of various types.

2. Description of the Prior Art

Exercise equipment employing a cable to which a weight is attached at one end with the cable passing over a plurality of pulleys to a handle attached at the opposite end is well known in the prior art. An example of such a device may be found in U.S. Pat. No. 5,613,928, issued to James A. Laudone. The handlebar shown in the Laudone reference includes a pair of hand gripping bars for right and left hands joined by a gear. However, there is no teaching in the Laudone reference to permanently fix the angle between the two bars. Rather, the motion between the two bars is spring-loaded to provide an exercise device in the handlebar itself.

A handlebar intended to be adjustable for use with exercise equipment such as a so-called "universal gym," is shown in U.S. Pat. No. 5,273,509, issued to Larry W. Vittone. The Vittone patent shows and describes a pair of adjustable handlebars 42 each connected to a base 40 through a ball joint formed from a ball 60 on one end of each handlebar 42. The ball 60 fits into a cylindrical housing 64 attached to the base 40. A threaded upper housing section 94 cooperates with a threaded lower housing section 90 to form a spherical cavity that grips the ball 60 when the upper housing is tightened upon the lower housing. This arrangement is relatively expensive to manufacture. Further, there is no reference point for a user to establish a desired setting between the pair of handlebars 40 once each ball 60 attached thereto has been loosened for readjustment. This makes it difficult for a user to properly adjust the handlebar from one exercise to another or from one user to another.

SUMMARY OF THE INVENTION

The present invention provides an adjustable handlebar that may be economically fabricated for use by many users. It has been found that different individuals require various angles at which to place their hands when pulling or pushing a handlebar attached to the cable of an exercise machine. If the angle of the handlebar is not correct for an individual user, use can result in tendinitis in the hands or arms.

Accordingly, it is an object of the present invention to provide an improved adjustable handlebar.

Another object of the present invention is to provide an adjustable handlebar that may be adjusted to a number of readily-identified positions.

A further object of the present invention to provide an adjustable handlebar that may be attached to the cable of an exercise machine at more than one angle.

In accomplishing these and other objects, there is provided a handlebar with first and second handles. The first handle is attached to a disc having a central aperture and a plurality of apertures surrounding the central aperture. The second handle, having a pivotal aperture, is attached to the first handle by a first fastening device. The second handle has a second aperture therein through which a second fastener may be passed into one of the plurality of apertures in the disc attached to the first handle. By adjusting the position of the second fastener within one of the plurality of apertures in the disc surrounding the first handle, the position of the first and second handles may be easily adjusted to provide an adjustable handlebar whose position may be quickly established.

DESCRIPTION OF THE DRAWINGS

Other objects and advantages of the present invention will be understood after reference to the following specification and drawings, wherein.

DESCRIPTION OF THE PREFERRED EMBODIMENT

Figure 1:
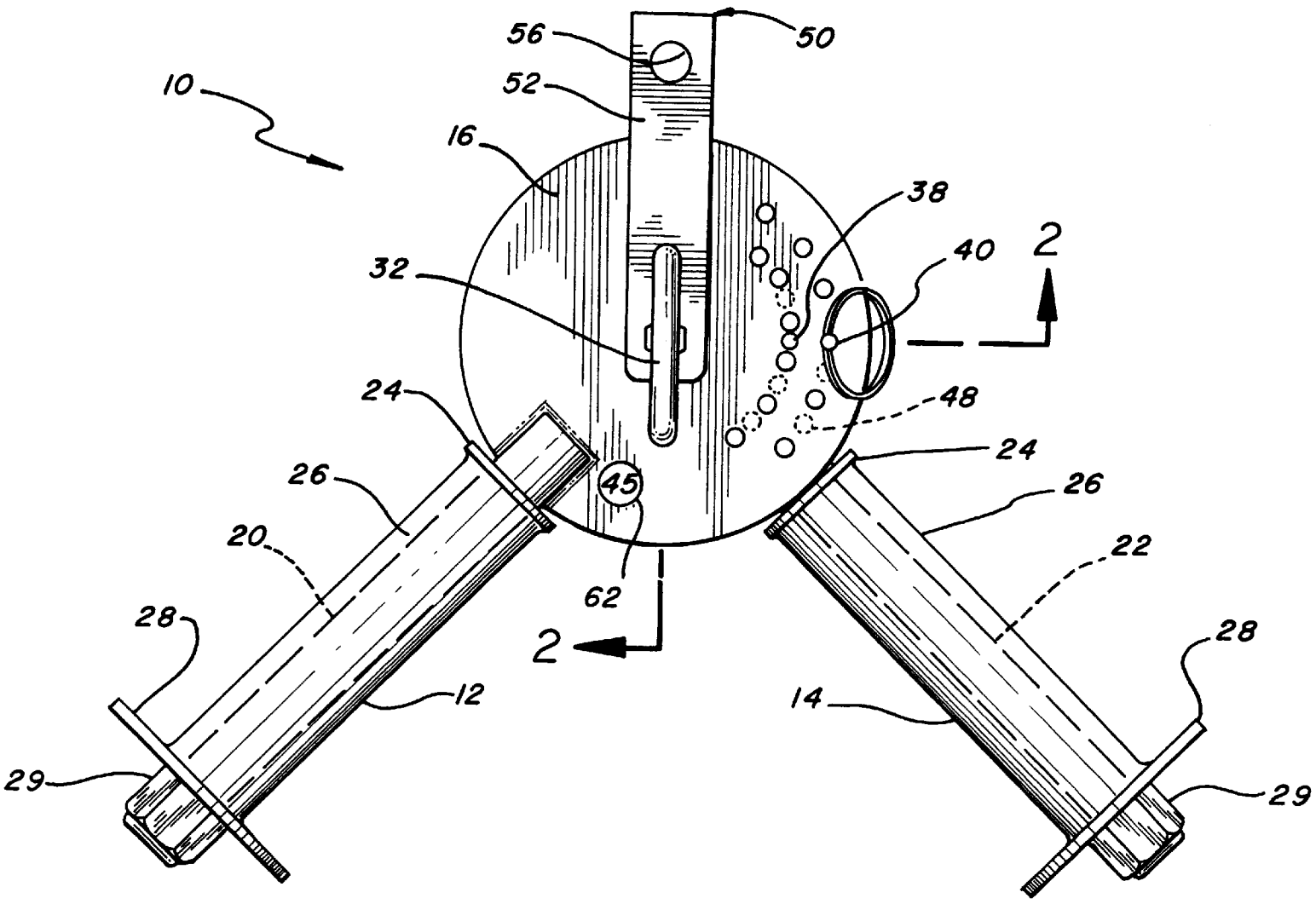
FIG. 1 is a top, plan view of an adjustable handlebar of the present invention.
Figure 2:
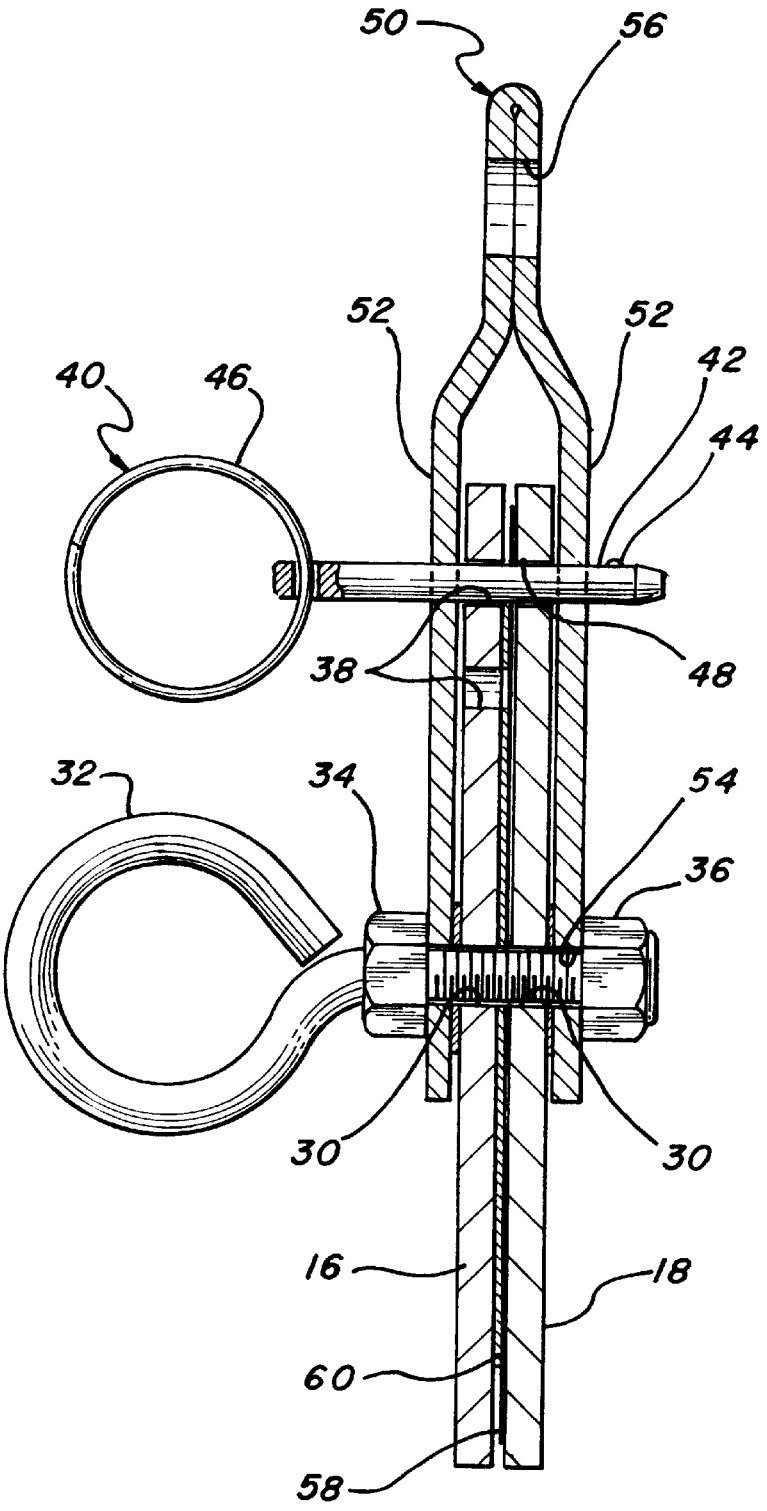
FIG. 2 is a cross-sectional view taken along line 2—2 of FIG. 1.

Referring now to the drawings, FIG. 1 shows an adjustable handlebar 10 of the present invention having a first handle 12 and second handle 14 each attached, respectively, to a first and second disc 16 and 18, best seen in FIG. 2. First and second handles 12 and 14 are formed by a pair of steel rods 20 and 22 whose inner ends are provided with flats, not shown, that abut against the surface of the discs 16 and 18 and are attached thereto as by welding. A pair of washers 24 are placed upon the rods 20 and 22, followed by a pair of sleeves 26 and a pair of larger washers 28. The outer ends of the rods 20 and 22 have been threaded to receive a pair of nuts 29, which may be of the self-locking kind, for retaining the sleeves 26 upon the rods 20 and 22 to complete the subassembly of handles 12 and 14. This arrangement provides a rolling grip for the user which, in turn, provides a more comfortable adjustable handlebar. The larger washers 28 at the end of the grip help secure the handle in the user's hands.

As seen in FIG. 2, the first and second discs 16 and 18 each have a centrally located pivotal aperture 30 through which a first fastener 32 is passed. In the embodiment shown in FIGS. 1 and 2, the first fastener is a steel eye bolt 32, having a threaded shank to which a first nut 34 is attached for abutment against disc 16. The shank is then passed through disc 18 and a second locking nut 36 is attached to secure fastener 32.

Figure 5:
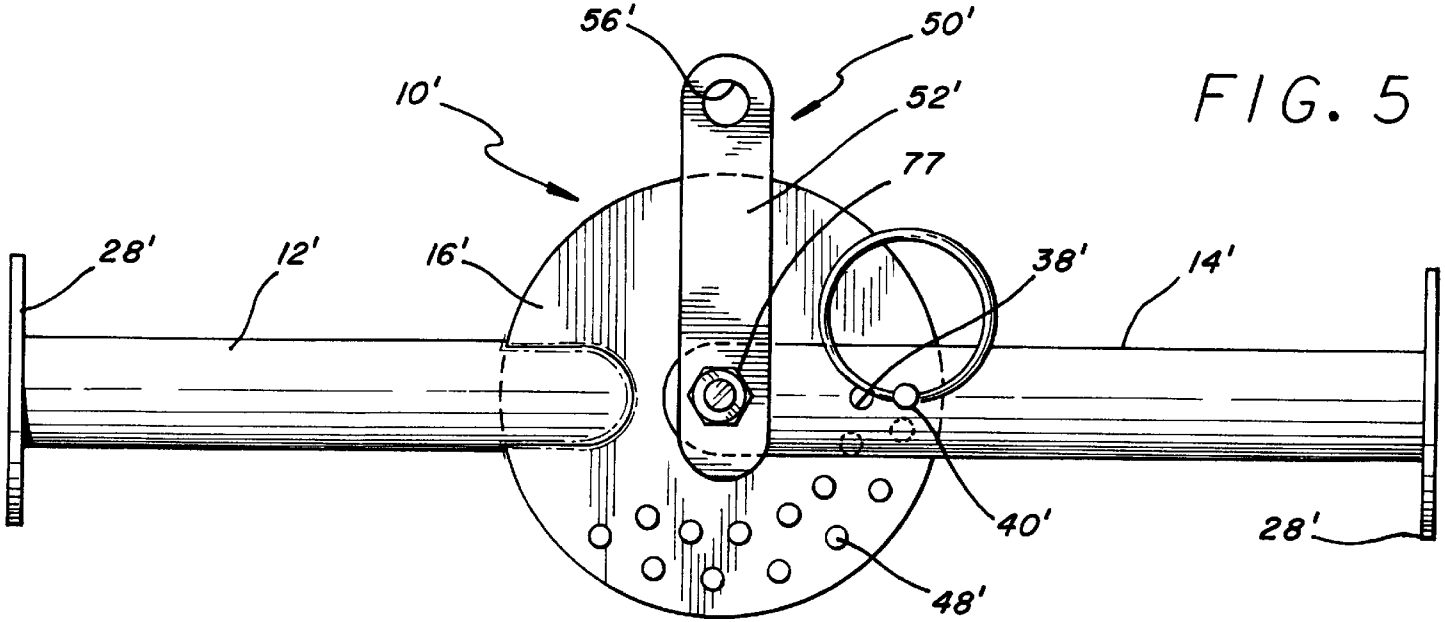
FIG. 5 is a top, plan view of a second embodiment of the adjustable handlebar of the present invention.

As seen in FIG. 2, the first disc 16 is provided with a pair of apertures 38 spaced along a common diameter but at two different radii from the center where the pivotal aperture 30 is located. A second fastener 40 which, in the embodiment shown on FIG. 2, is formed from a pin 42 having a detent 44 at one end and a ring 46 at the other, passes through one of the apertures 38 in the first disc 16 and into one of a plurality of other apertures 48 in the second disc 18. The plurality of apertures 48 in the second disc 18 are arranged on a plurality of diameters at the same two radii as the radii that locate apertures 38 in the first disc 16. As best seen in FIG. 5, the apertures 48 are separated along the inner radius by ten degrees, for example, and along the outer radius by the same angle. Other angles, such as fifteen degrees, may be used.

A third fastener 50 or keeper is formed by bending a flattened piece of steel, for example, into a U-shaped configuration and then bending the resulting legs 52 of the U-shape outwardly and then inwardly to form a Y-shape whose parallel legs 52 pass along the outer surfaces of first and second discs 16 and 18. The lower ends, as seen in FIG. 1, of the separated and parallel legs 52 are provided with an aperture 54 through which the eye bolt 32 passes. The upper, contacting ends of the legs 52 are provided with an aperture 56 which, like the eye of eye bolt 32, accommodates fastening the adjustable handlebar 10 to a cable of an exercise machine.

The adjustable handlebar assembly 10 is completed by an indicator disc 58, such as a piece of high-quality paper, which is glued or otherwise fastened to the inner surface of the second disc 18. A second, transparent disc 60, such as a piece of plastic, is inserted between the indicator disc 58 and first disc 16. Finally, an aperture 62 is provided in the first disc 16, through which one may view indicia upon the inner surface of indicator disc 58 through the transparent disc 60 which protects the paper disc 58. Discs 58 and 60 may be eliminated by simply stamping, engraving, or otherwise affixing the desired indicia to the inner surface of disc 18 and positioning the aperture 62 in disc 16 to expose at least one of the indicia. In the preferred embodiment, that indicia is the angle at which the adjustable handlebar 10 has been adjusted, depending on which apertures 38 and 48 have been aligned to receive the fastener 40.

Figure 3:
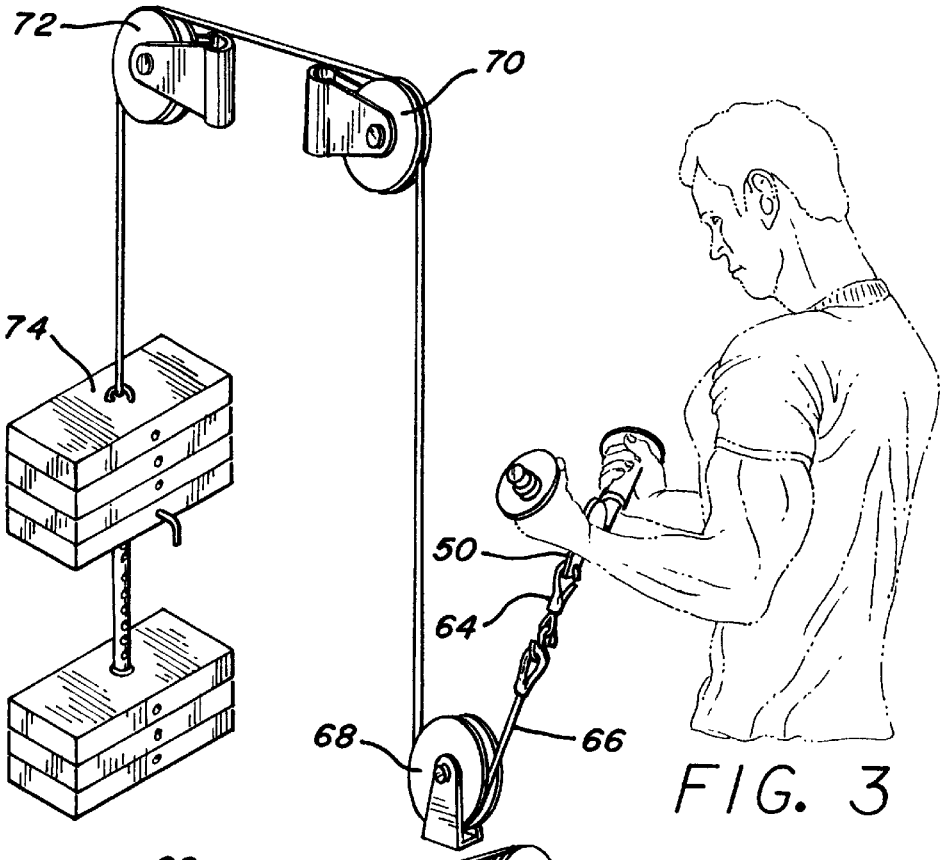
FIG. 3 illustrates the adjustable handlebar of FIG. 1 being used in an exercise machine.

Use of the adjustable handlebar 10 shown in FIG. 1 is demonstrated in FIG. 3, wherein the handlebar 10 is adjusted at a 45-degree angle between the longitudinal axis of the shaft 20 and the longitudinal axis of shaft 22 that form the two handles 12 and 14. In this embodiment, the third fastener or keeper 50 is utilized, wherein the aperture 56 receives a clip 64 attached to a cable 66. The cable 66 runs over pulleys 68, 70 and 72, with its distal end attached to a weight stack 74. In FIG. 3, the exercise being performed is known as a curl.

Figure 4:
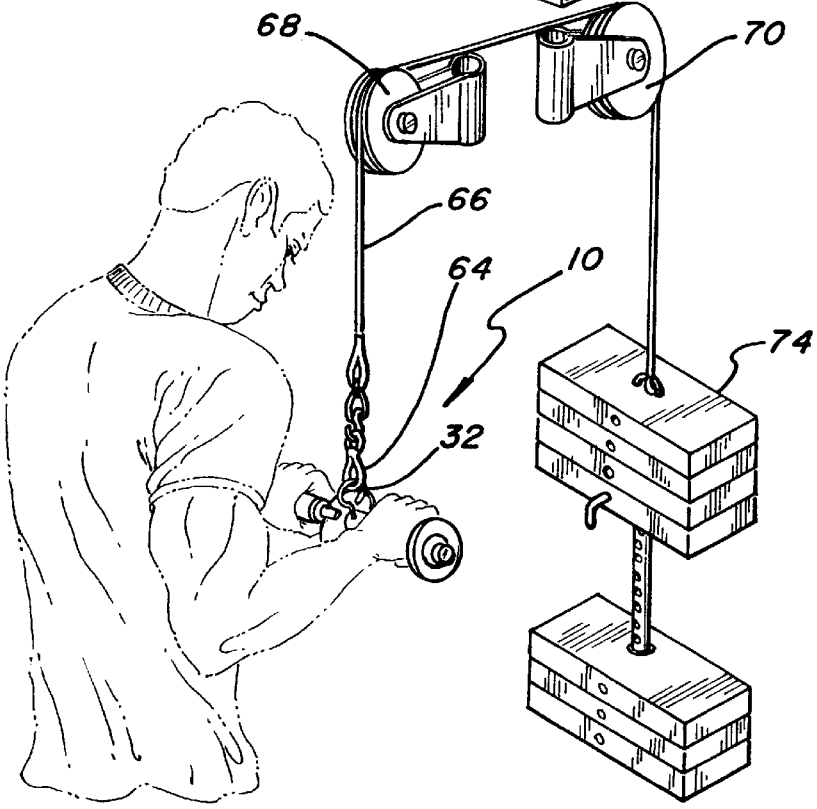
FIG. 4 shows the adjustable handlebar of FIG. 1, at a second adjusted position, being used for a second exercise in an exercise machine.

In FIG. 4, a triceps push-down exercise is illustrated, wherein the adjustable handlebar 10 is adjusted at an angle of zero degrees between the longitudinal axes of the handles 12 and 14 so that the handles form an in-line position. In this use of the adjustable handlebar 10, the eye bolt fastener 32 which acts as a keeper is attached to clip 64 and then to cable 66 which runs over pulleys 68 and 70 before it attaches to the weight stack 74. It will be understood that, by alternately using the eye bolt fastener 32 or as a keeper 50, the pitch of the handlebar 10 relative to the cable 66 may be adjusted.

Figure 6:
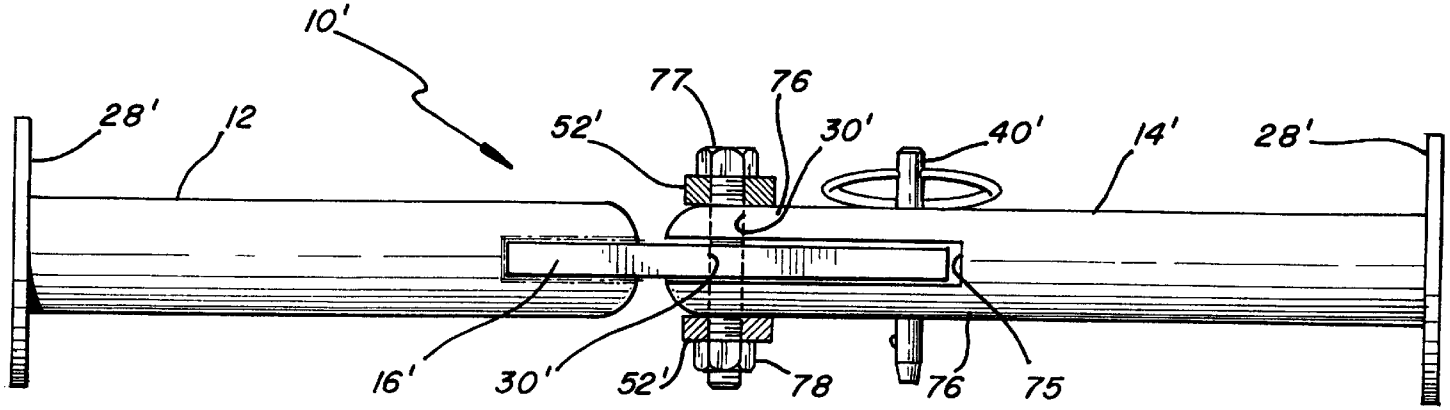
FIG. 6 is a side view of FIG. 5.

Referring now to FIGS. 5 and 6, a second embodiment of the invention is illustrated. The adjustable handlebar 10' includes first and second handles 12' and 14', wherein the first handle 12' is attached, as by welding, to a first disc 16'. The first disc 16' is provided with a pivotal aperture 30' and a plurality of radially spaced apertures 48'. As in FIG. 1, the radially spaced aperture 48' are located on a plurality of diameters at two different radii from the centrally located aperture 30'. The inner row of apertures 48' are spaced ten degrees apart, for example, while the outer row is also spaced ten degrees apart, but offset by five degrees from the inner row. The second handle 14' is not attached to a disc but is provided with a slot 75 that forms two legs 76 at one end thereof. Each leg 76 has a central aperture 30' that is aligned within the same aperture 30' in disc 16'. The two handles are held together by a fastener which, in FIGS. 5 and 6, is a bolt 77 and locking nut 78. Mounted between the bolt 77 and the locking nut 78 and the legs 76 of the second handle 14' are legs 52' of a third fastener or keeper 50'. To complete the assembly, a pair of large washers 28' are attached to the ends of handles 12' and 14' as by flathead screws, not shown. The angle between the handles 12' and 14' of the handlebar 10' is shown at zero degrees in FIGS. 5 and 6 and is maintained in this position by a detent pin fastener 40' passed through one of two apertures 38' in handle 14'. The embodiment described in FIGS. 5 and 6 is a less expensive variation of the embodiment shown in FIGS. 1 and 2.

Figure 7:
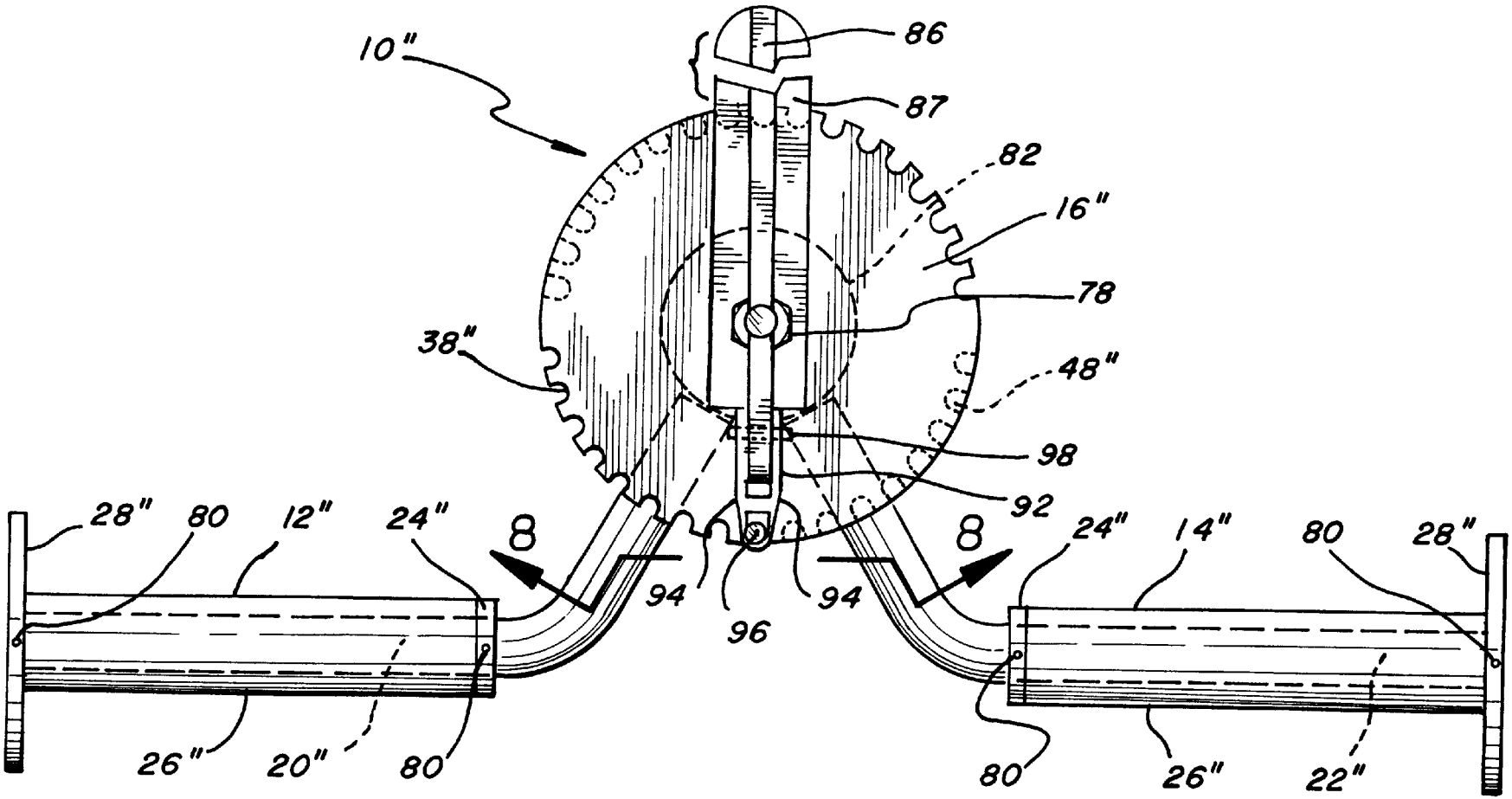
FIG. 7 is a top, plan view of a third embodiment of the adjustable handlebar of the present invention.
Figure 8:
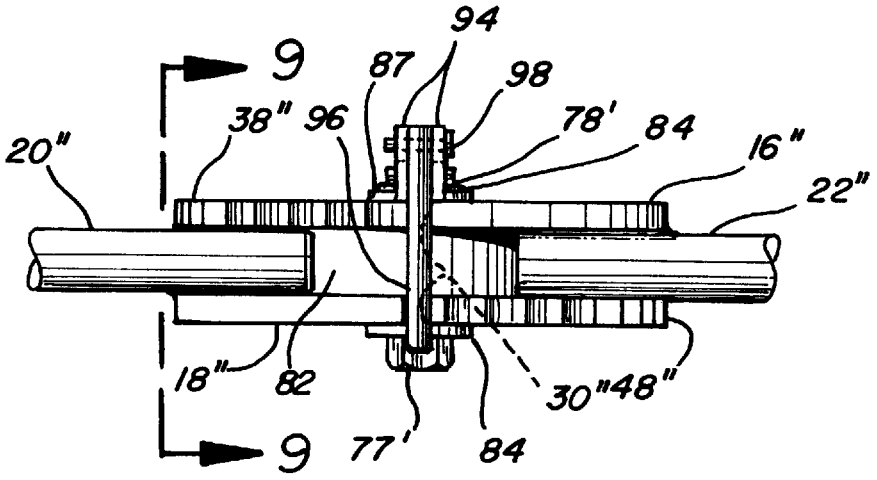
FIG. 8 is a side view of FIG. 7 taken along line 8—8 of FIG. 7.

Referring now to FIGS. 7, 8, 9 and 10, a further embodiment of the present invention is illustrated, wherein an adjustable handlebar 10" is formed from first and second rods 20" and 22" into handles 12" and 14" each attached, as by welding, to first and second discs 16" and 18". In the embodiment shown in FIGS. 7–10, the rod 20" is attached by welding to disc 18", while rod 22" is attached to disc 16". If desired, first washers 24" are slid over the first and second rods 20" and 22" and attached thereto as by roll pins 80. Sleeves 26" follow and then second washers 38" also attached by roll pins 80. Discs 16" and 18" are spaced apart, as best seen in FIG. 8, by spacer shim 82. The rotational movement of disc 16", with respect to disc 18", is maintained by a bolt 77', which passed through pivotal aperture 30" in discs 16" and 18", and a locking nut 78'. To enhance the rotation of the two discs 16" and 18", washers 84 may be made of a low-friction material, such as Teflon®.

Figure 9:
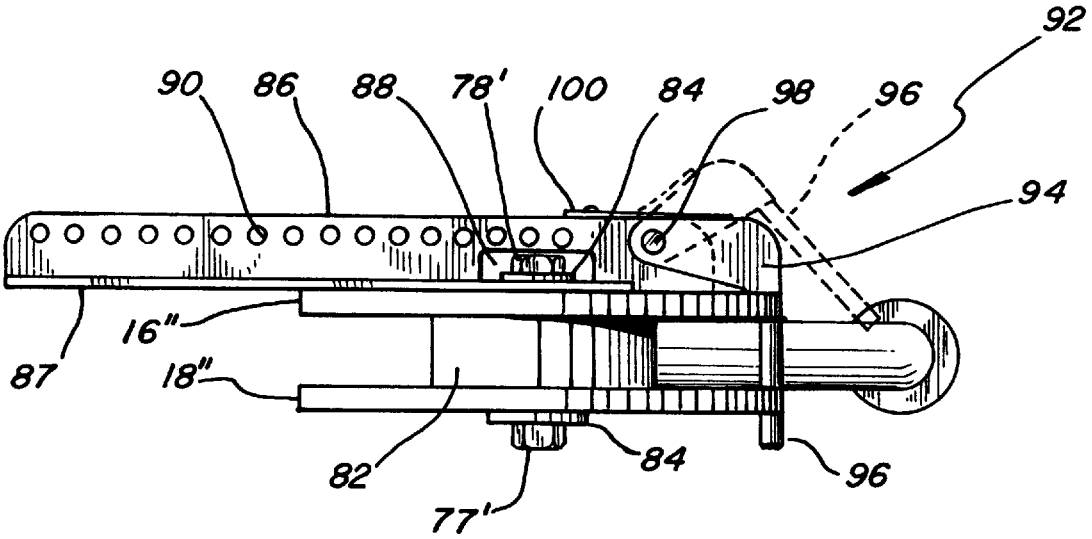
FIG. 9 is a side view of a keeper mechanism taken along line 9—9 of FIG. 8

In the embodiment of FIGS. 7 through 10, the fastening mechanism that locks the discs 16" and 18" at different angles while permitting adjustment of the angles between handles 12" and 14" is best shown in FIG. 9. Here, a keeper bar 86 is shown in side view having a length extending beyond the diameter of disc 16" to which it is attached. The keeper bar 86 is formed into an inverted, T-shaped cross-section by a plate 87 that may be attached to the bar 86, as by welding. The plate 87 has an aperture through which bolt 77' may pass, while the bar 86 is relieved by a slot 88 to provide a clearance for locking nut 78'. A plurality of apertures 90 are also provided along the surface of bar 86, starting to the left of center in FIG. 9 and extending toward one end thereof. These apertures 90 may be utilized to receive the clip 64, shown in FIGS. 3 and 4 thus permitting keeper bar 86 to attached handlebar 10"to exercise equipment. At the opposite end of bar 86 from apertures 90, a locking mechanism 92 is mounted that may be formed by a pair of parallel plates 94 spaced apart by a pin 96 which is attached thereto, as by welding. The locking mechanism 92, thus assembled, is attached to the keeper bar 86 by a suitable fastener, such as a bolt and locking nut or roll pin 98, which passes through suitable apertures in plates 94 and keeper 86. As seen in FIG. 7, the discs 16" and 18" are provided with a plurality of apertures 38" and 48", respectively. In the embodiment shown, these apertures are semicircular notches formed in the outer edge of discs 16" and 18" for receiving the pin 96 of locking mechanism 92. The locking mechanism 92 may be provided with a suitable leaf spring mechanism 100 for urging the pin 96 into the position shown in FIG. 9.

Figure 10:
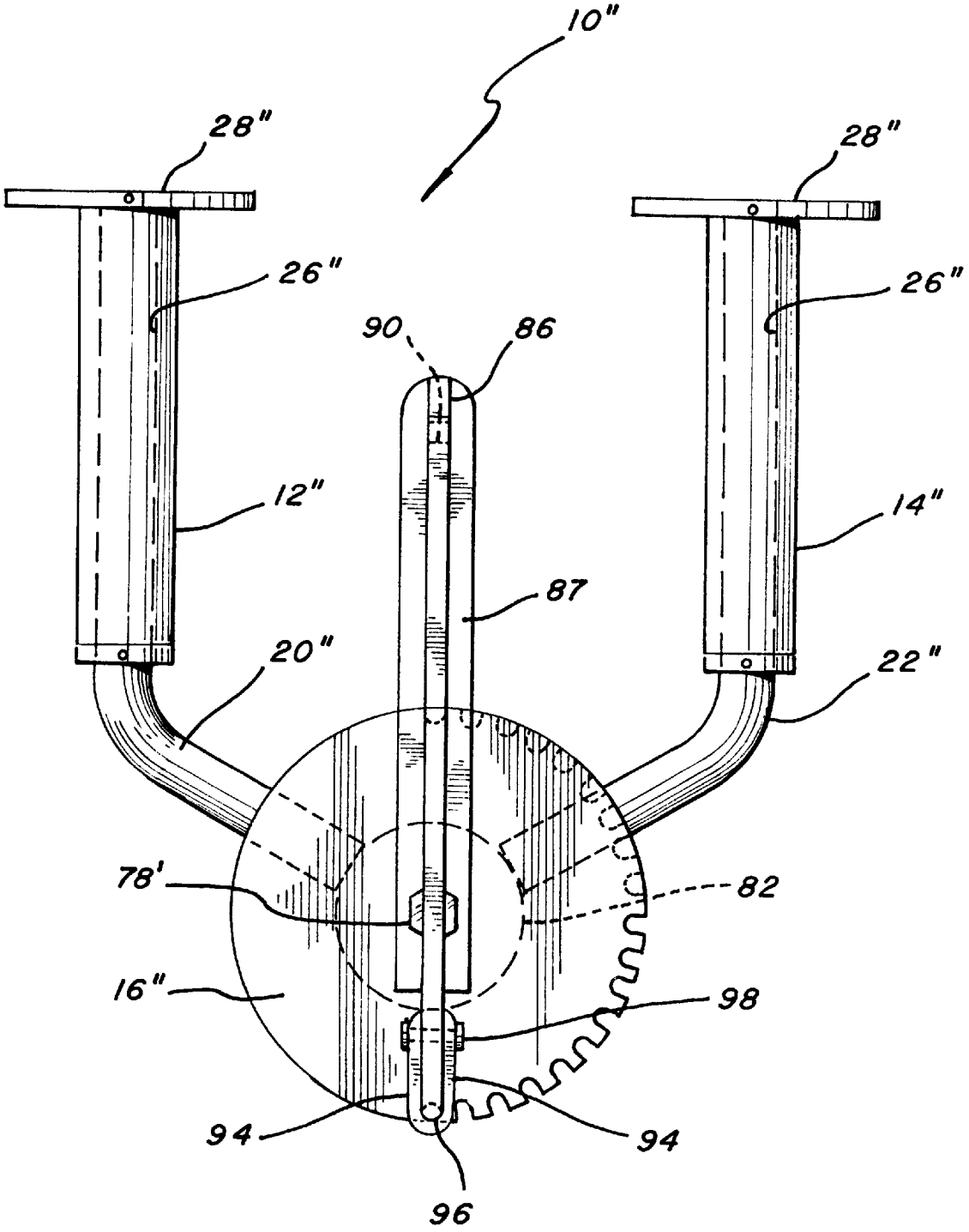
FIG. 10 is a top, plan view of the embodiment of the adjustable handlebar shown in FIG. 7 in a second, adjusted position.

As seen in FIGS. 7 and 10, the first and second handles 12" and 14" of the adjustable handlebar 10" need not be formed on straight shafts 20" or 22". Rather, the shafts may be bent at angles, depending upon the desires of the designer and/or manufacturer. One reason for such a bend is shown in FIG. 10, wherein handles 12" and 14" have been adjusted to a position where they are parallel to one another. In FIG. 10, another advantage of the adjustable handlebar 10" is shown. That is, the handles 12" and 14" may be adjusted from an in-line position (FIG. 7) to a parallel position (FIG. 10). It will now be observed that the parallel handles 12" and 14" are also parallel with keeper 86 located between the handles. Attachment via clip 64 to one of the apertures 90 in the keeper 86 permits the adjustable handlebar 10" to be placed into still other exercise position for the user's hands.

As best seen in FIG. 9, the keeper bar 86 and plate 87 may be rotationally attached atop the disc 16" by the nut 78', bolt 77' and washers 84. This is one reason for using the clearance slot 88 in keeper bar 86 to permit the nut 78' to be inserted into the clearance slot 88 to engage the bolt 77' and further engage the top surface of plate 87. As viewed in FIG. 10, it will be seen that the keeper bar 86 may be rotated 180° from the position shown so that the keeper extends in parallel with handles 12" and 14" but in the opposite direction therefrom. This permits the adjustable handlebar 10" to be used in yet another exercise position.

Other variations of the present invention are possible. For example, rather than apertures, for fixing the rotational spacing of the discs, it is possible to machine gear-like teeth or fan-shaped serration into the inner surfaces of discs 16 and 18 and to replace eye bolt 32 with a locking mechanism that would force the teeth or serration into contact with one another to fix the position of the discs. In this embodiment, the disc could be configured as shown in FIGS. 1 and 2. Other variations and modifications are possible within the teachings of the present invention which should be limited only by the appended claims.

I claim:

1. An adjustable handlebar for use with exercise equipment, comprising:

first and second handles each having a longitudinal axis;

said first handle having a disc attached thereto, said disc having a centrally located aperture and a plurality of other apertures therein;

said second handle having a pivotal aperture and at least one additional aperture therein;

a fastener passing through said centrally located aperture in said disc attached to said first handle and through said pivotal aperture in said second handle to pivotally join said first and second handles;

a keeper for connecting said handlebar to said exercise equipment; and a pin passing through said at least one additional aperture in said second handle and one of said plurality of other apertures in said first handle, wherein the selection of one of said plurality of other apertures in said first handle through which to pass said pin adjusts the angle of said longitudinal axis of first handle in relation to said longitudinal axis of second handle.

2. The adjustable handlebar, as claimed in claim 1, wherein:

said fastener is an eye bolt secured to said first and second handles and wherein said keeper is the eye of said bolt.

3. The adjustable handlebar, as claimed in claim 1, wherein:

said keeper has parallel legs disposed on either side of said disc and connected to said first and second handles by said first mentioned fastener.

4. The adjustable handlebar, as claimed in claim 1, wherein said second handle having a pivotal aperture and at least one additional aperture therein additionally comprises:

a second disc attached to said second handle having said pivotal aperture centrally passing therethrough and said at least one additional aperture therein.

5. The adjustable handlebar, as claimed in claim 4, additionally comprising:

an indicator disc disposed between said first mentioned disc and said second disc having indicia on one surface thereof, and said first-mentioned disc having an aperture therein to expose said indicia on said indicator disc.

6. An adjustable handlebar for use with exercise equipment, comprising:

first and second handles each having a longitudinal axis;

said first handle having a first disc attached thereto, said first disc having a centrally located aperture and a plurality of other apertures therein;

said second handle having a second disc attached thereto, said second disc having a centrally located aperture and at least one additional aperture therein;

a first fastener passing through said centrally located apertures in said first and second discs to pivotally join said first and second handles;

a second fastener passing through said at least one additional aperture in said second disc and one of said plurality of other apertures in said first disc, wherein the selection of one of said plurality of other apertures in said first disc through which to pass said second fastener adjusts the angle of said longitudinal axis of first handle in relation to said longitudinal axis of second handle; and a keeper for connecting said handlebar to said exercise equipment.

7. The adjustable handlebar, as claimed in claim 6, wherein:

said first fastener is an eye bolt secured to said first and second discs and wherein said keeper is the eye of said bolt.

8. The adjustable handlebar, as claimed in claim 6, additionally comprising:

an indicator disc disposed between said first and second discs having indicia on one surface thereof, and said first disc having an aperture therein to expose said indicia on said indication disc.

9. The adjustable handlebar, as claimed in claim 6, additionally comprising:

said second fastener is a pin having a detent at one end and a gripping ring at the other.

10. An adjustable handlebar, as claimed in claim 6, wherein:

said first and second handles have an angular offset along said longitudinal axis of each handle.

11. An adjustable handlebar, as claimed in claim 6, additionally comprising:

said second disc having indicia on the inner surface;

said first disc having an aperture therein exposing one of said indicia, wherein the angular relationship of the longitudinal axes of said first and second handles is indicated.

12. An adjustable handlebar, as claimed in claim 6, wherein:

said first and second discs each have apertures therein that extend to permit said first and second handles to be adjusted from an in-line to a parallel position.

13. The adjustable handlebar, as claimed in claim 6, wherein:

said keeper has parallel legs disposed on either side of said discs and connected to said first and second handles by said first fastener.

14. The adjustable handlebar, as claimed in claim 13, wherein:

said first fastener is an eye bolt whose eve forms a second keeper configured to attach said handlebar to said exercise equipment at a first pitch, and said fit-mentioned keeper may alternately be used to attach said handlebar to said exercise equipment at a second pitch.

15. The adjustable handlebar, as claimed in claim 6, additionally comprising:

said first disc having said plurality of other apertures wherein said apertures are formed by notches in the outer edge of said first disc;

said second disc having said at least one aperture wherein said at least one aperture is formed by at least one notch in the outer edge of said second disc;

said second fastener includes a pin for engagement within said notches in the outer edges of said first and second discs.

16. An adjustable handlebar, as claimed in claim 15, additionally comprising:

said keeper formed from a keeper bar mounted upon said first disc; and a pivotal locking mechanism attached to said keeper bar, said locking mechanism including said pin to form said second fastener.

* * * * *